US011708214B2

(12) United States Patent
Sartorius et al.

(10) Patent No.: US 11,708,214 B2
(45) Date of Patent: Jul. 25, 2023

(54) HYBRID CARGO CONTAINER SYSTEMS

(71) Applicant: The Boeing Company, Chicago, IL (US)

(72) Inventors: Thomas Skyler Sartorius, San Luis Obispo, CA (US); Robert Erik Grip, Rancho Palos Verdes, CA (US)

(73) Assignee: The Boeing Company, Arlington, VA (US)

( * ) Notice: Subject to any disclaimer, the term of this patent is extended or adjusted under 35 U.S.C. 154(b) by 13 days.

(21) Appl. No.: 17/523,634

(22) Filed: Nov. 10, 2021

(65) Prior Publication Data

US 2023/0145428 A1 May 11, 2023

(51) Int. Cl.

| | |
|---|---|
| ***B65D 90/02*** | (2019.01) |
| ***B65D 90/00*** | (2006.01) |
| ***B65D 88/02*** | (2006.01) |
| ***B65D 88/14*** | (2006.01) |

(52) U.S. Cl.

CPC ..... *B65D 90/02* (2013.01); *B65D 88/022* (2013.01); *B65D 88/14* (2013.01); *B65D 90/0086* (2013.01)

(58) Field of Classification Search

CPC .... B65D 2585/6877; B65D 2585/6872; B65D 2585/6875; B65D 2585/686; B65D 2585/6862; B65D 2585/6865; B65D 2585/6867; B65D 2585/6887; B65D 90/02; B65D 88/022; B65D 88/14; B65D 90/0086

See application file for complete search history.

(56) References Cited

U.S. PATENT DOCUMENTS

| | | | | | |
|---|---|---|---|---|---|
| 3,480,178 | A * | 11/1969 | Morgan | B65D 1/34 | 206/520 |
| 3,651,977 | A * | 3/1972 | Morgan | B65D 21/06 | 206/506 |
| 4,210,252 | A * | 7/1980 | Cooke | B65D 11/1873 | 220/4.28 |
| 4,366,905 | A * | 1/1983 | Forshee | B65D 85/68 | 206/821 |
| 2005/0000834 | A1* | 1/2005 | Clive-Smith | B65D 88/129 | 206/335 |
| 2011/0247958 | A1* | 10/2011 | Lucas | B29C 66/12441 | 206/524.6 |

(Continued)

*Primary Examiner* — Kareen K Thomas

(74) *Attorney, Agent, or Firm* — McDonnell Boehnen Hulbert & Berghoff LLP

(57) ABSTRACT

In an example, a hybrid cargo container system for use with ground transportation vehicles and air transportation vehicles is disclosed. The cargo container system includes a chamfered container body comprising a plurality of sidewalls defining a storage chamber, the plurality of sidewalls comprising a first sidewall, a second sidewall, and a chamfer sidewall attached to the first and second sidewalls. The cargo container system also includes a corner support assembly operably coupled to the chamfered container body. The corner support assembly is operable between a stowed position and a deployed position. Based on the corner support assembly being in the deployed position, the corner support assembly is configured to at least partially support another container stacked thereon for ground transportation, and based on the corner support assembly being in the stowed position, the cargo container system is configured to be stored in a fuselage of an aircraft for air transportation.

23 Claims, 16 Drawing Sheets

(56) References Cited

U.S. PATENT DOCUMENTS

| | | | | |
|---|---|---|---|---|
| 2012/0076605 | A1* | 3/2012 | Crane | B65D 90/0033 410/46 |
| 2012/0202709 | A1* | 8/2012 | Bergo | B01J 19/0046 506/23 |
| 2015/0225973 | A1* | 8/2015 | Patoine | E04H 1/12 52/79.1 |
| 2018/0086548 | A1* | 3/2018 | Heath | B64F 1/322 |

* cited by examiner

HYBRID CARGO CONTAINER SYSTEMS

FIELD

The present disclosure relates generally to cargo containers, and more particularly, to hybrid cargo container systems for use with both ground transportation vehicles and air transportation vehicles.

BACKGROUND

Existing cargo containers used for intermodal transport are typically cuboid-shaped. Although such containers can be easily stacked, they are not ideal for use on aircraft, which typically have rounded cross-sections. As such, some existing cargo containers are designed with a chamfered corner in their cross-sections to better utilize the available space in aircrafts.

However, existing chamfered cargo containers are typically unable to be stacked on each other, due to corners being necessary for providing the required support. In addition, stacking and storage of such chamfered containers typically requires specialized racks. Furthermore, such chamfered containers are typically only used for the airborne leg of a journey, which can incur undesired costs and inefficiencies in the packing and unpacking of goods to and from such containers, as opposed to keeping goods in the same container for multiple legs of a journey.

Thus, what is needed is a cargo container that is less costly and more efficient for use with intermodal travel involving an aircraft.

SUMMARY

In an example, a hybrid cargo container system for use with ground transportation vehicles and air transportation vehicles is disclosed. The hybrid cargo container system includes a chamfered container body comprising a plurality of sidewalls defining a storage chamber, the plurality of sidewalls comprising a first sidewall, a second sidewall, and a chamfer sidewall attached to the first sidewall and the second sidewall. The hybrid cargo container system also includes a corner support assembly operably coupled to the chamfered container body, where the corner support assembly is operable between a stowed position and a deployed position, where based on the corner support assembly being in the deployed position, the corner support assembly is configured to at least partially support another container stacked thereon for ground transportation, and where based on the corner support assembly being in the stowed position, the hybrid cargo container system is configured to be stored in a fuselage of an aircraft for air transportation.

In another example, another hybrid cargo container system for use with ground transportation vehicles and air transportation vehicles is disclosed. The hybrid cargo container system includes a chamfered container body comprising a plurality of sidewalls defining a storage chamber, the plurality of sidewalls comprising a first sidewall that defines a first plane, a second sidewall that defines a second plane transverse to the first plane, and a chamfer sidewall that defines a chamfer plane that is non-orthogonal relative to the first plane and the second plane. The hybrid cargo container system also includes a corner support assembly removably coupled to the chamfered container body, where based on the corner support assembly being coupled to the chamfered container body, the hybrid cargo container system defines a first planar support region and is configured to at least partially support another container stacked thereon for ground transportation, and where based on the corner support assembly being removed from the chamfered container body, the hybrid cargo container system defines a second planar support region, smaller than the first planar support region, and is configured to be stored in a fuselage of an aircraft for air transportation.

In yet another example, a method is disclosed. The method includes moving a corner support assembly of a hybrid cargo container system from a deployed position to a stowed position, where based on the corner support assembly being in the deployed position, the corner support assembly is configured to at least partially support another container stacked thereon. The method also includes loading the hybrid cargo container system into a fuselage of an aircraft based on the corner support assembly being in the stowed position.

In yet another example, a hybrid cargo container system is disclosed. The hybrid cargo container system includes a chamfered container body comprising a plurality of sidewalls defining a storage chamber, the plurality of sidewalls comprising a pair of lateral sidewalls, a pair of longitudinal sidewalls longer than the pair of lateral sidewalls, an upper sidewall, a lower sidewall, and a chamfer sidewall that is attached to, and extends transverse between, the upper sidewall and one longitudinal sidewall of the pair of longitudinal sidewalls. The hybrid cargo container system also includes a pair of supports pivotably coupled to opposite ends of the one longitudinal sidewall or to the pair of lateral sidewalls, where the pair of supports are rotatable between a stowed position and a deployed position, where based on the pair of supports being in the deployed position, the hybrid cargo container system defines a first volume and is configured to at least partially support another container stacked thereon, and where based on the pair of supports being in the stowed position, the hybrid cargo container system defines a second volume that is less than the first volume The features, functions, and advantages that have been discussed can be achieved independently in various examples or may be combined in yet other examples. Further details of the examples can be seen with reference to the following description and drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

Figure 1:
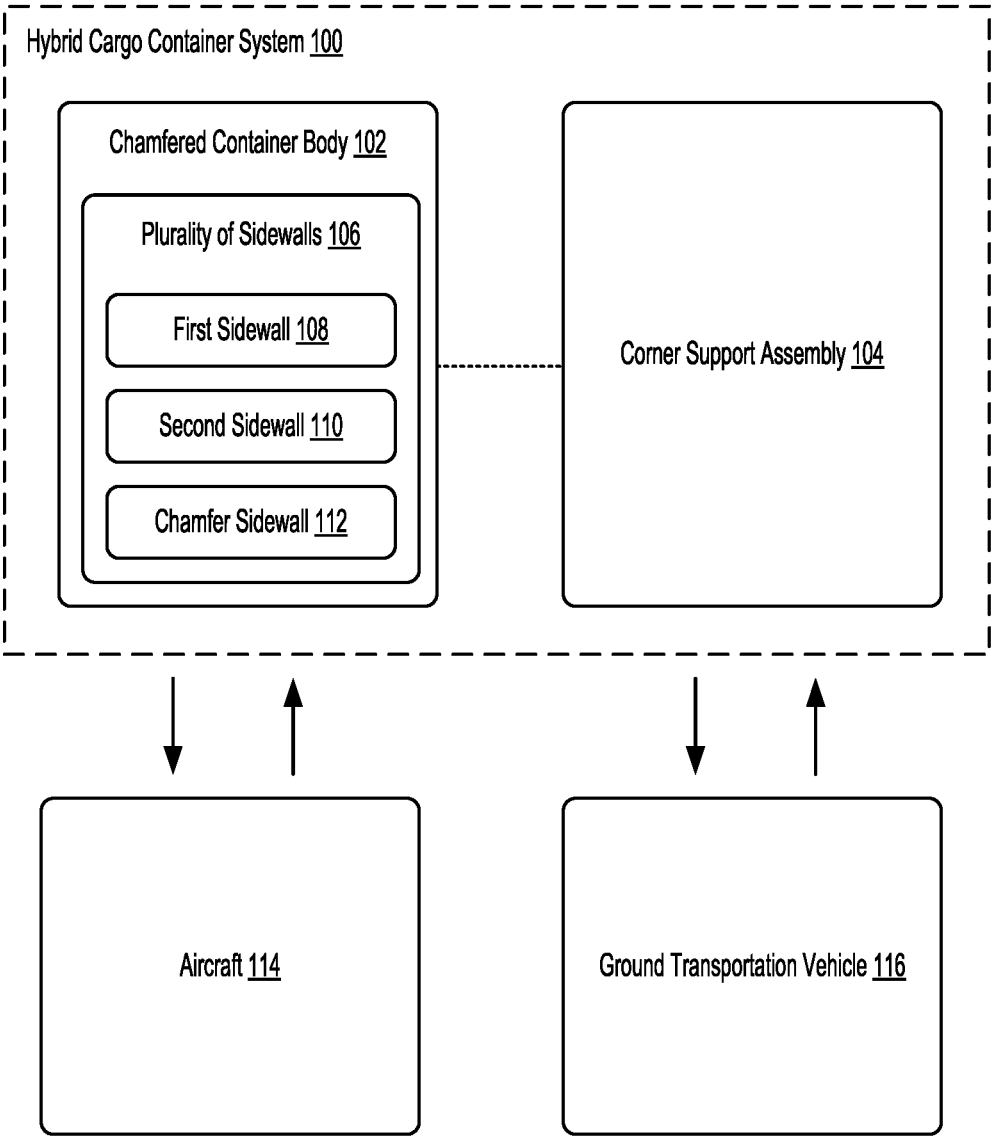
FIG. 1 depicts a hybrid cargo container system, according to an example implementation.

Disclosed examples will now be described more fully hereinafter with reference to the accompanying drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

Unless otherwise specifically noted, elements depicted in the drawings are not necessarily drawn to scale.

Within examples, described herein are hybrid cargo container systems and a corresponding method for use with ground transportation vehicles and air transportation vehicles.

The disclosed hybrid cargo container system includes a chamfered container body having a plurality of sidewalls defining a storage chamber for cargo, the plurality of sidewalls including a first sidewall, a second sidewall, and a chamfer sidewall attached to the first sidewall and the second sidewall. Within examples, the chamfered container body is prism-shaped with a pentagonal cross section. The chamfer in the container body can allow for the hybrid cargo container system to be stored in an aircraft or other location having a curved sidewall that would otherwise be incompatible with typical container corners.

The disclosed hybrid cargo container system also includes a corner support assembly operably coupled to the chamfered container body. The corner support assembly is operable between a stowed position and a deployed position, such that, with the corner support assembly in the deployed position, the corner support assembly is configured to at least partially support another container stacked thereon for ground transportation, and with the corner support assembly being in the stowed position, the hybrid cargo container system is configured to be stored in a fuselage of an aircraft for air transportation.

Accordingly, the hybrid cargo container system can be efficiently transferred between ground and air transportation by transitioning the corner support assembly between the stowed and deployed positions.

These and other improvements are described in more detail below. Implementations described below are for purposes of example. The implementations described below, as well as other implementations, may provide other improvements as well.

Referring now to the figures, FIG. 1 depicts a hybrid cargo container system 100, according to an example implementation. The various elements of the hybrid cargo container system 100 could be formed from one or more materials such as aluminum, steel, plastic, and/or another material. Furthermore, it will be understood that, in addition to the parts of the elements shown in FIG. 1, any of such elements can include parts that are not explicitly shown in FIG. 1.

The hybrid cargo container system 100 includes a chamfered container body 102 and a corner support assembly 104. The chamfered container body 102 has a plurality of sidewalls 106, which includes a first sidewall 108, a second sidewall 110, and a chamfer sidewall 112 attached to the first sidewall 108 and the second sidewall 110. The plurality of sidewalls 106 define a storage chamber within which cargo can be disposed.

As discussed in more detail below, the corner support assembly 104 is operably coupled to the chamfered container body 102 and used to facilitate storage of the hybrid cargo container system 100 in both aircraft and ground transportation vehicles, representative examples of which are depicted in FIG. 1 as aircraft 114 and ground transportation vehicle 116.

As noted above, for example, the corner support assembly 104 is operable between a stowed position and a deployed position. Based on the corner support assembly 104 being in the deployed position, the corner support assembly 104 is configured to at least partially support another container (not shown) stacked thereon for ground transportation, such as when the hybrid cargo container system 100 is storage on or in the ground transportation vehicle 116 (e.g., on a truck bed). And based on the corner support assembly 104 being in the stowed position, the hybrid cargo container system 100 is configured to be stored in the aircraft 114 (e.g., a fuselage of the aircraft 114) for air transportation.

In some cases, the hybrid cargo container system 100 can be positioned upside-down such that the chamfer sidewall 112 is facing a ground surface. When the hybrid cargo container system 100 is positioned in this way and the corner support assembly 104 is in the deployed position, the hybrid cargo container system 100 can be stacked on another container in this way as well, and can also support another container stacked thereon.

The aircraft 114 can take the form of various types of aircraft, such as commercial or non-commercial aircraft. The ground transportation vehicle 116 can take various forms as well, such as a truck.

The corner support assembly 104 can be operably coupled to the chamfered container body 102 in various ways. For example, the corner support assembly 104 is rotatably coupled by way of a pivot or other mechanism. As another example the corner support assembly 104 is removably fastened to one or more of the plurality of sidewalls 106 of the chamfered container body 102, such as by way of one or more bolts, screws, etc. As yet another example, the corner support assembly 104 is manufactured to be integral with one or more of the plurality of sidewalls 106. Other examples are possible as well.

Figure 2:
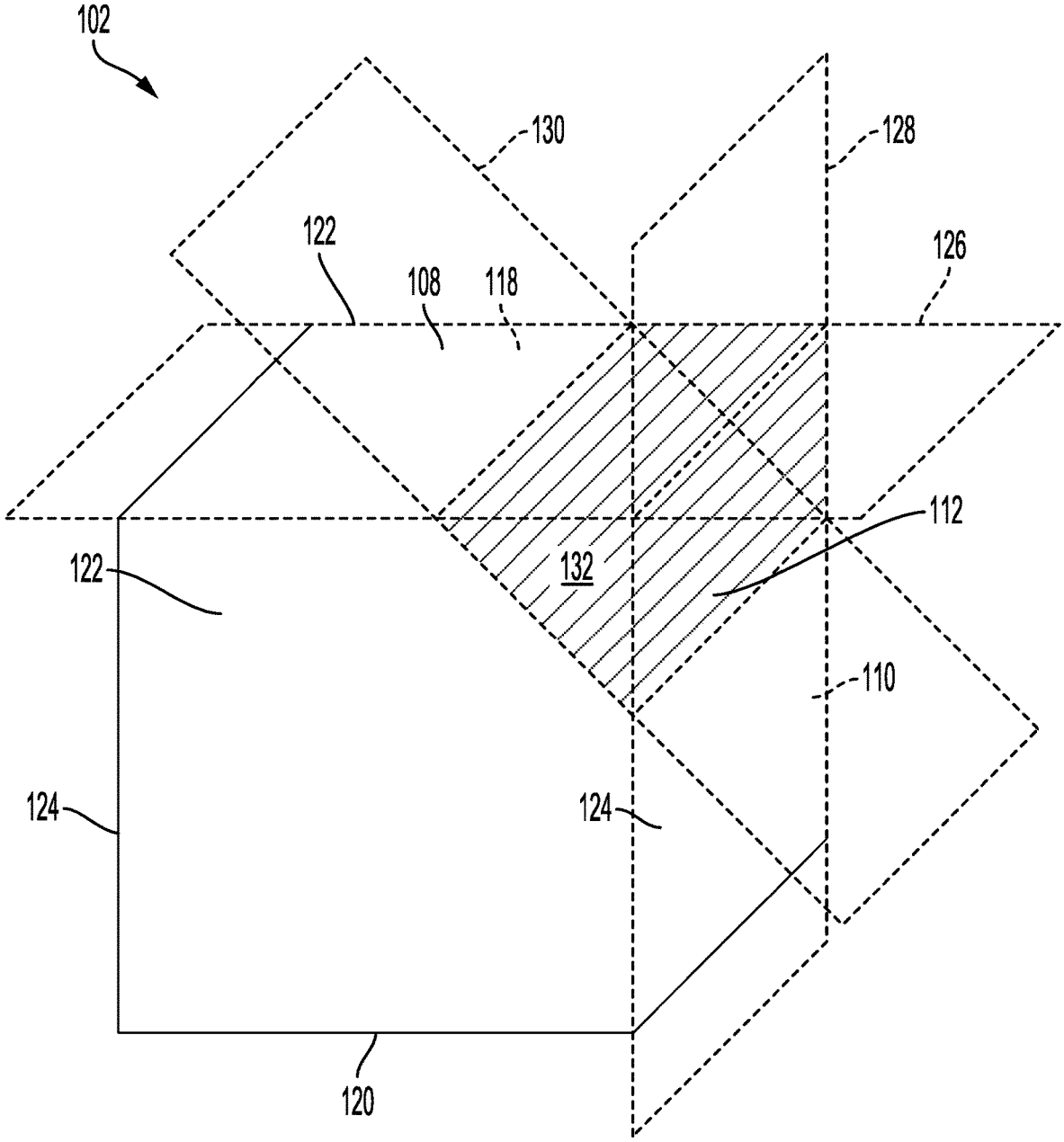
FIG. 2 depicts a perspective view of a chamfered container body, according to an example implementation.

FIG. 2 depicts a perspective view of the chamfered container body 102, according to an example implementation. The example of the chamfered container body 102 shown in FIG. 2 is prism-shaped with a pentagonal cross section.

As shown, the plurality of sidewalls 106 (not explicitly designated in FIG. 2) includes an upper sidewall 118 (i.e., the first sidewall 108) and a lower sidewall 120, opposite the upper sidewall 118. In addition, the plurality of sidewalls 106 includes a pair of lateral sidewalls 122, a pair of longitudinal sidewalls 124, and the chamfer sidewall 112. The chamfer sidewall 112 is attached to, and extends transverse between, the upper sidewall 118 and one longitudinal sidewall of the pair of longitudinal sidewalls 124—namely, the second sidewall 110.

Within examples, the pair of longitudinal sidewalls 124 can be longer than, approximately the same length as, or shorter than, the pair of lateral sidewalls 122.

As further shown, the first sidewall 108 (i.e., the upper sidewall 118) defines a first plane 126, the second sidewall 110 defines a second plane 128 transverse to the first plane 126, and the chamfer sidewall 112 defines a chamfer plane 130 that is non-orthogonal relative to the first plane 126 and the second plane 128.

Also shown in FIG. 2 is a corner space 132 that is exterior to and adjacent to the chamfer sidewall 112. Although the corner space 132 is depicted as a volume of space bound by the first plane 126, the second plane 128, and the chamfer plane 130, the corner space 132 can be larger in other embodiments, and can be considered to extend beyond the bounds of the first plane 126 and the second plane 128.

FIGS. 3-10 depict example embodiments in which the corner support assembly 104 has a plurality of posts that are rotatably coupled to the chamfered container body 102 and rotatable between the deployed position and the stowed position.

In particular, FIGS. 3, 4, 5, 6, 7, and 8 depict an example of the corner support assembly 104 in which the corner support assembly 104 includes a pair of supports 134 that are pivotably coupled to the pair of lateral sidewalls 122.

Figure 3:
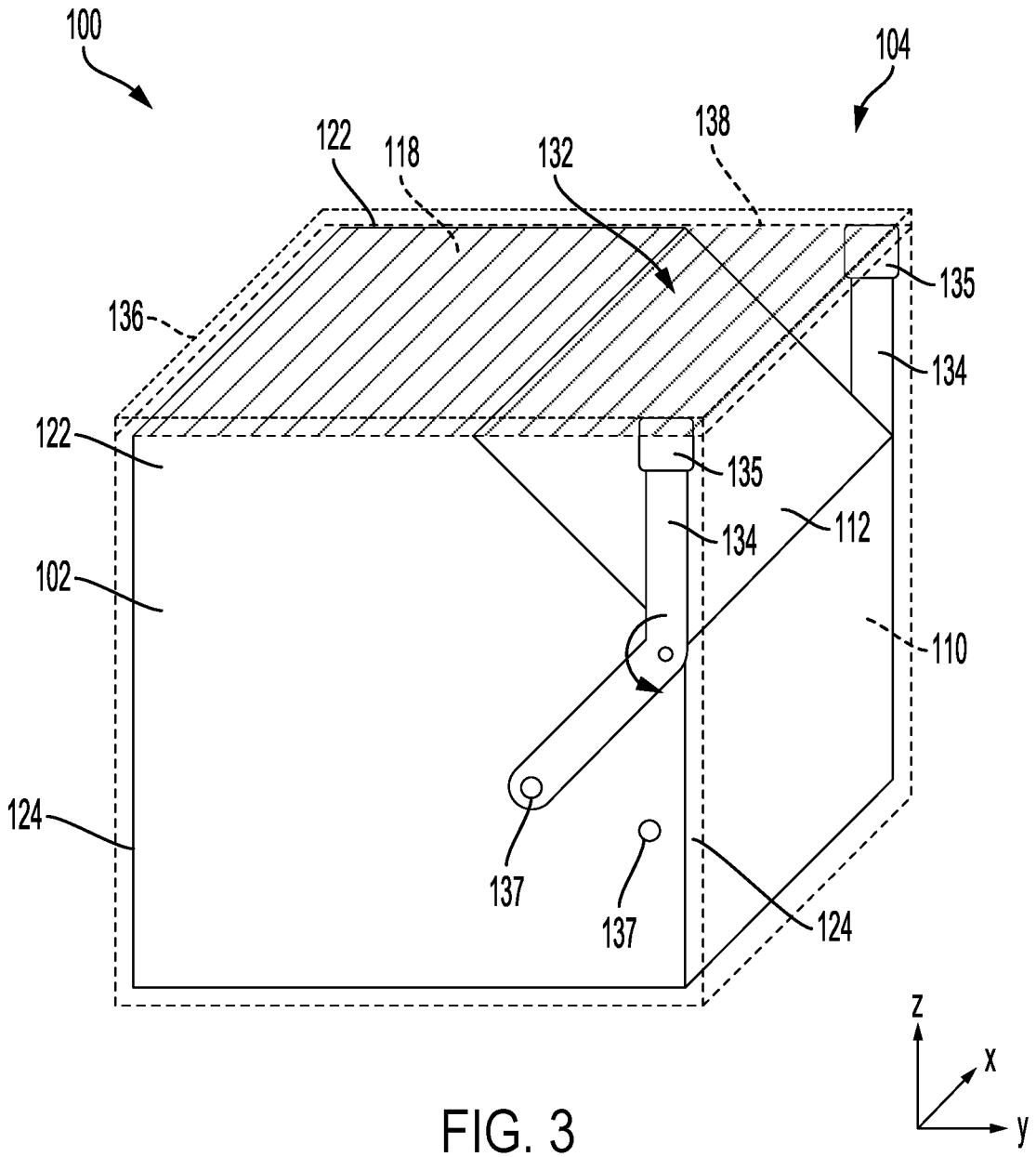
FIG. 3 depicts the hybrid cargo container system with the corner support assembly in the deployed position, according to an example implementation.

FIG. 3 depicts the hybrid cargo container system 100 with the corner support assembly 104 in the deployed position, according to an example implementation.

As shown, the pair of supports 134 are rotatable between the stowed position and the deployed position. In some cases, a human operator can manually rotate each of the pair of supports 134 individually. In other cases, the pair of supports 134 can be rotatable via an electromechanical, pneumatic, or hydraulic mechanism. For reference, FIG. 3 includes an arrow depicting the direction in which the pair of supports 134 can rotate from the deployed position to the stowed position.

Although not explicitly shown in FIG. 3, one or both of the supports of the pair of supports 134 can be integral with, or be coupled to, one or more mechanisms that can be used to rotate the pair of supports 134, such as detachable levers. Additionally, such mechanisms can include springs to reduce actuation loads. Further, in some cases, the corner support assembly 104 can include a torsion member (not shown), such as a tube or rod, that can be used to substantially simultaneously rotate the pair of supports 134 between the deployed position and the stowed position. Such a torsion member can be located exterior to the chamfered container body 102 or integrated within the chamfered container body 102 (e.g., integrated as part of the second sidewall 110) and can extend longitudinally (i.e., parallel to the x-axis) between the pair of supports 134, by way of example.

As further shown, the pair of supports include corner fittings 135. The corner fittings 135 can be made of steel, carbon, or another material, and can be configured to (i) connect the hybrid cargo container system 100 to another container, such as another such system or another type of container (e.g., an un-chamfered, cuboid-shaped container) and (ii) connect the hybrid cargo container system 100 to a transport vehicle such as the aircraft 114, the ground transportation vehicle 116, or another type of vehicle (e.g., a watercraft). Further, although not explicitly shown in FIG. 3, other corner fittings, the same as or different from the type of corner fittings of corner fittings 135, can be coupled to each of the other six corners of the chamfered container body 102 and used for the same purpose as corner fittings 135.

Based on the pair of supports 134 being in the deployed position, the hybrid cargo container system 100 defines a first volume 136 and is configured to at least partially support another container stacked thereon (not shown). Phrased another way, with the corner support assembly 104 in the deployed position, the hybrid cargo container system 100—namely, the upper sidewall 118 and the pair of supports 134—define(s) a first planar support region 138 configured to at least partially support another container stacked thereon for ground transportation. For illustrative purposes, the first volume 136 is shown to be larger than the actual volume that the hybrid cargo container system 100 occupies in space when in the deployed position.

As further shown, based on the corner support assembly 104 being in the deployed position, the corner support assembly 104 extends into the corner space 132 that is exterior to and adjacent to the chamfer sidewall 112.

In embodiments where the corner support assembly 104 is removably coupled to the chamfered container body 102 and based on the corner support assembly 104 being coupled to the chamfered container body 102, the corner support assembly 104 can occupy at least a portion of the corner space 132 and the hybrid cargo container system defines the first planar support region 138 and is configured to at least partially support another container stacked thereon for ground transportation. Whereas, based on the corner support assembly 104 being decoupled and removed from the chamfered container body 102, the corner support assembly 104 will not occupy any portion of the corner space 132, or will occupy less of the corner space 132 than when the corner support assembly 104 is attached to the chamfered container body 102, and the hybrid cargo container system 100 defines a second planar support region (not shown in FIG. 3, but shown in FIG. 4), smaller than the first planar support region 138, and is configured to be stored in a fuselage of an aircraft for air transportation.

FIG. 3 also shows a plurality of securing mechanisms 137, which are represented as black dots. In practice, the plurality of securing mechanisms 137 can be or include latches, detents, plungers, or other devices that can be coupled to or integral with the corner support assembly 104 and/or the chamfered container body 102 and used as a means for securing the corner support assembly 104 in the stowed position and in the deployed positions.

Figure 4:
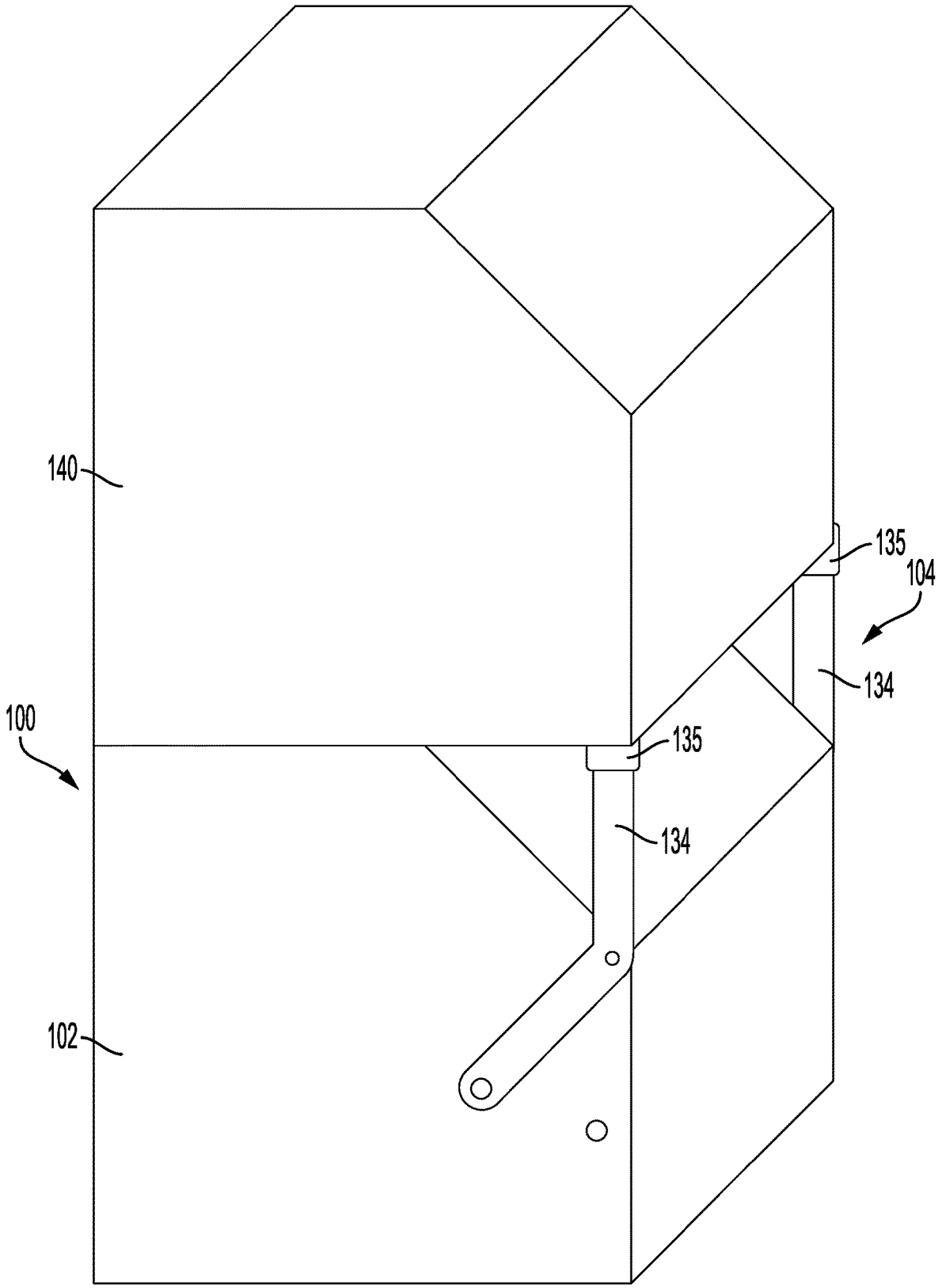
FIG. 4 depicts the hybrid cargo container system of FIG. 3 supporting another container stacked thereon, according to an example implementation.

FIG. 4 next depicts the hybrid cargo container system 100 with the corner support assembly 104 in the deployed position and supporting another container 140 stacked thereon, according to an example implementation. As shown, the pair of supports 134 are supporting the bottom right of the other container 140. Although not explicitly shown, the hybrid cargo container system 100 could be connected to the other container 140 by way of the corner fittings 135.

Figure 5:
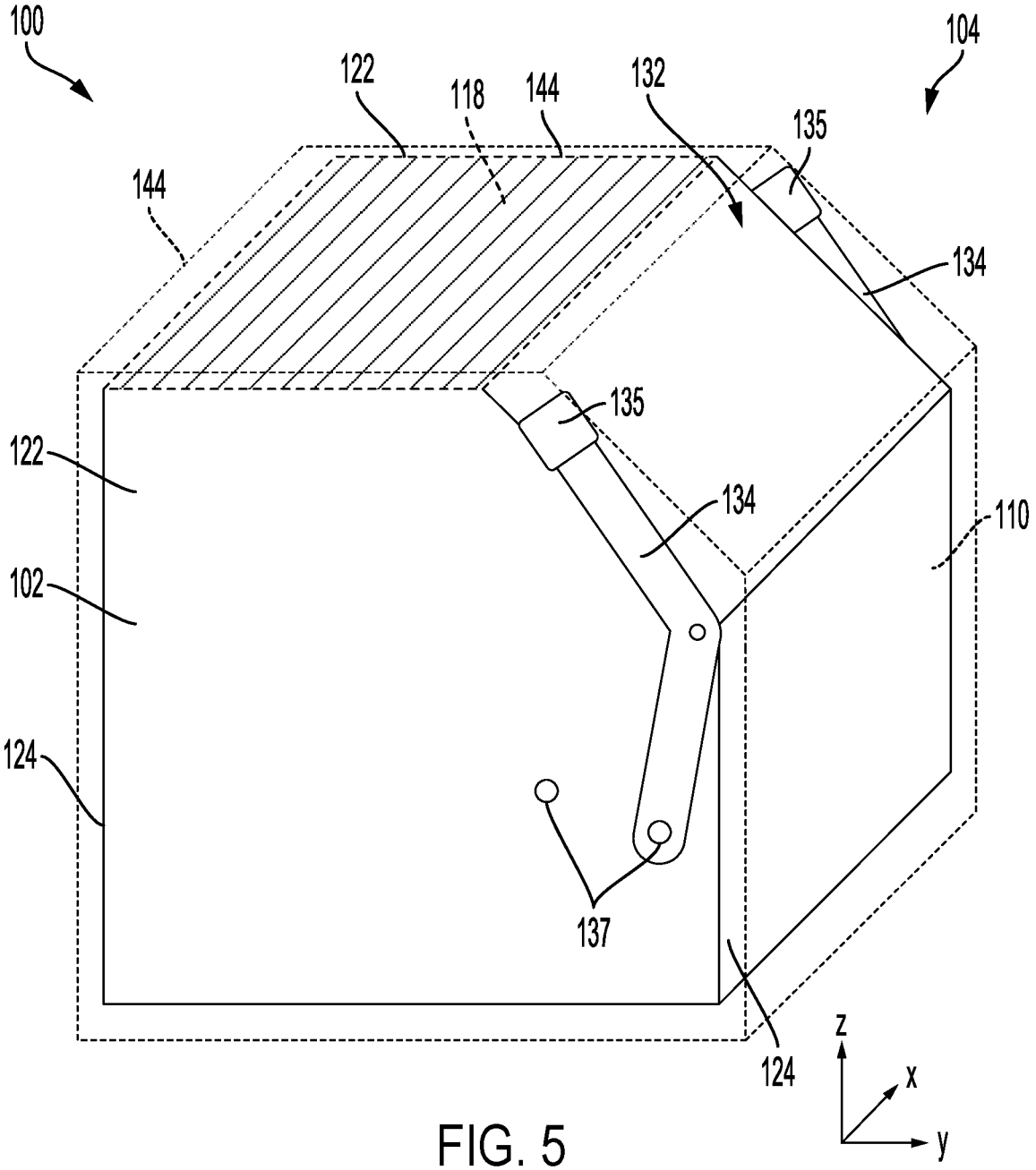
FIG. 5 depicts the hybrid cargo container system of FIG. 3 with the corner support assembly in the stowed position, according to an example implementation.

FIG. 5 depicts the hybrid cargo container system 100 with the corner support assembly 104 in the stowed position, according to an example implementation. As shown, based on the pair of supports 134 being in the stowed position, the hybrid cargo container system 100 defines a second volume 142 (which is less than the first volume 136 shown in FIG. 3). Phrased another way, with the corner support assembly 104 in the stowed position, the hybrid cargo container system 100—namely, the upper sidewall 118—defines a second planar support region 144, smaller than the first planar support region 138 shown in FIG. 3, and is configured to be stored in a fuselage of an aircraft for air transportation. For illustrative purposes, the second volume 142 is shown to be larger than the actual volume that the hybrid cargo container system 100 occupies in space when in the stowed position.

As further shown, based on the corner support assembly 104 being in the stowed position, the corner support assembly 104 is retracted toward the chamfer sidewall 112 and occupies less of the corner space 132 than when in the deployed position.

Figure 6:
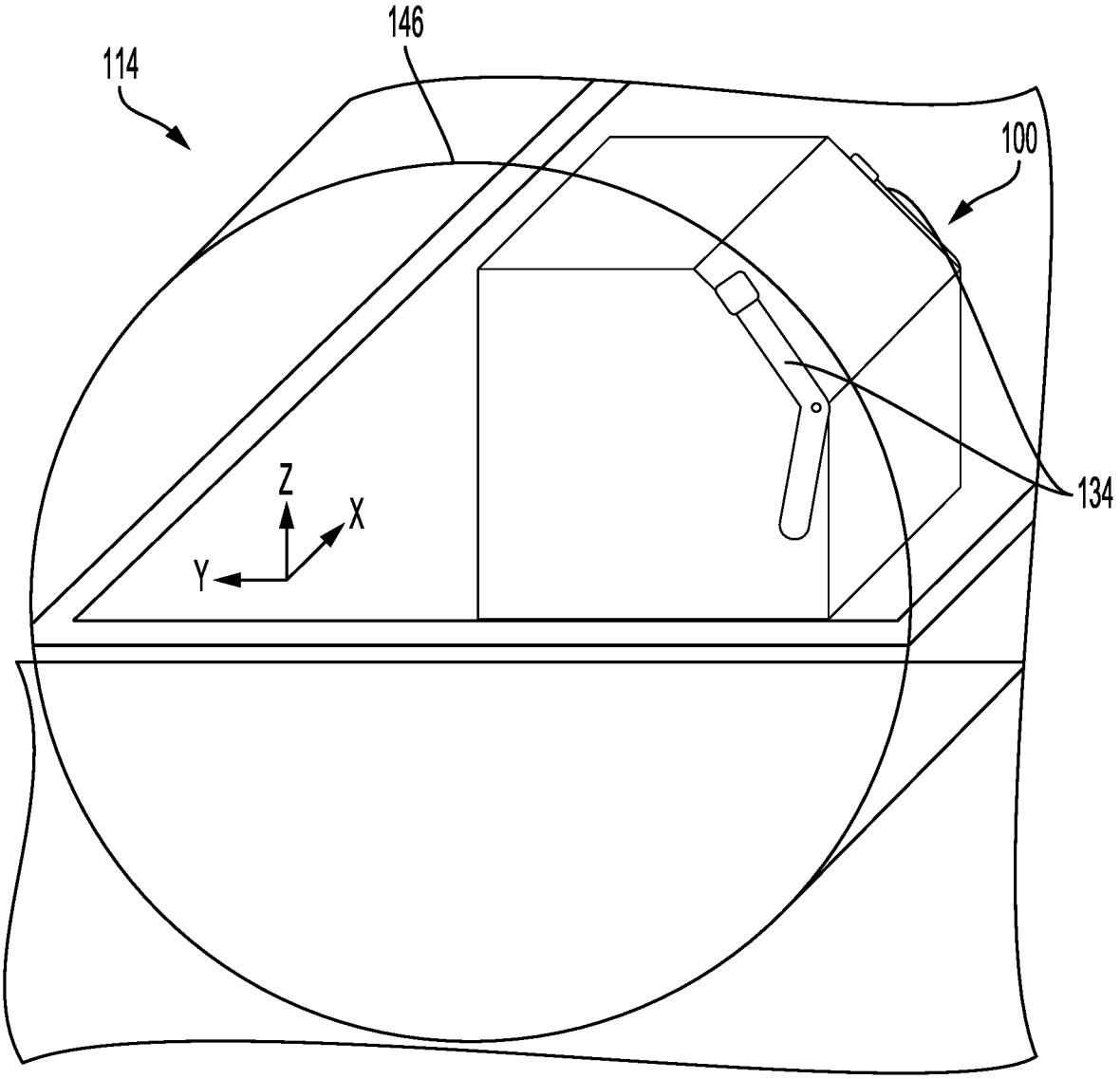
FIG. 6 depicts a perspective view of the hybrid cargo container system of FIG. 3 stored in a fuselage of an aircraft, according to an example implementation.

FIG. 6 next depicts a perspective view of the hybrid cargo container system 100 stored in a fuselage 146 of the aircraft 114, according to an example implementation. As shown, the pair of supports 134 are in the stowed position, thus allowing the hybrid cargo container system 100 to be stored in the fuselage 146.

Figure 7:
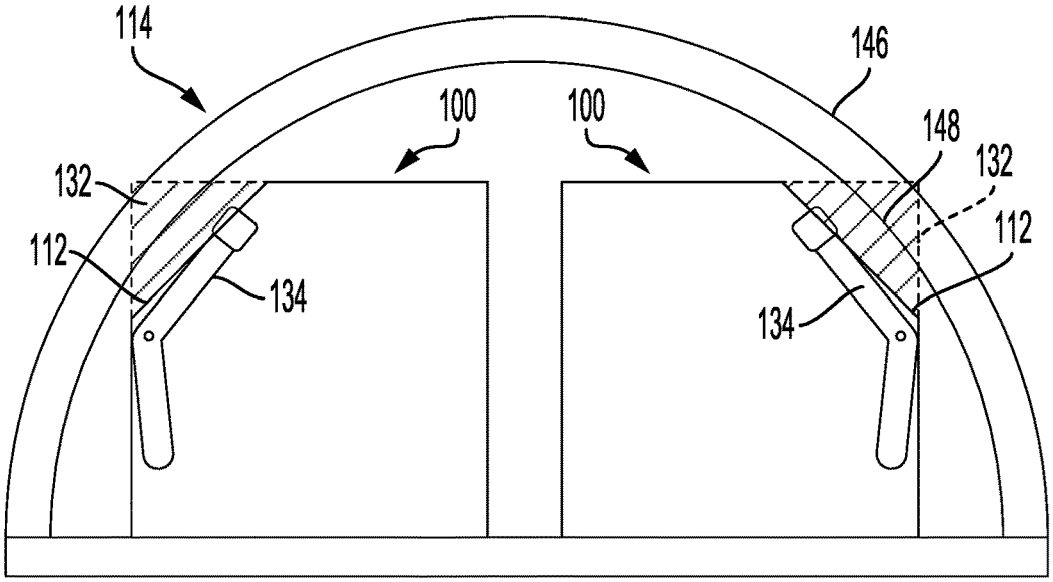
FIG. 7 depicts a front view of two hybrid cargo container systems stored next to each other in a fuselage of an aircraft, according to an example implementation.

FIG. 7 depicts a front view of two of the hybrid cargo container system 100 stored next to each other in the fuselage 146 of the aircraft 114, according to an example implementation. As shown for each such system, the pair of supports 134 are in the stowed position and, with the pair of supports 134 in the stowed position, the hybrid cargo container system 100 can be stored proximate to a respective side of the fuselage 146, particularly such that a curved sidewall 148 of the fuselage 146 occupies at least a portion of the corner space 132 exterior to and adjacent to the chamfer sidewall 112.

Figure 8:
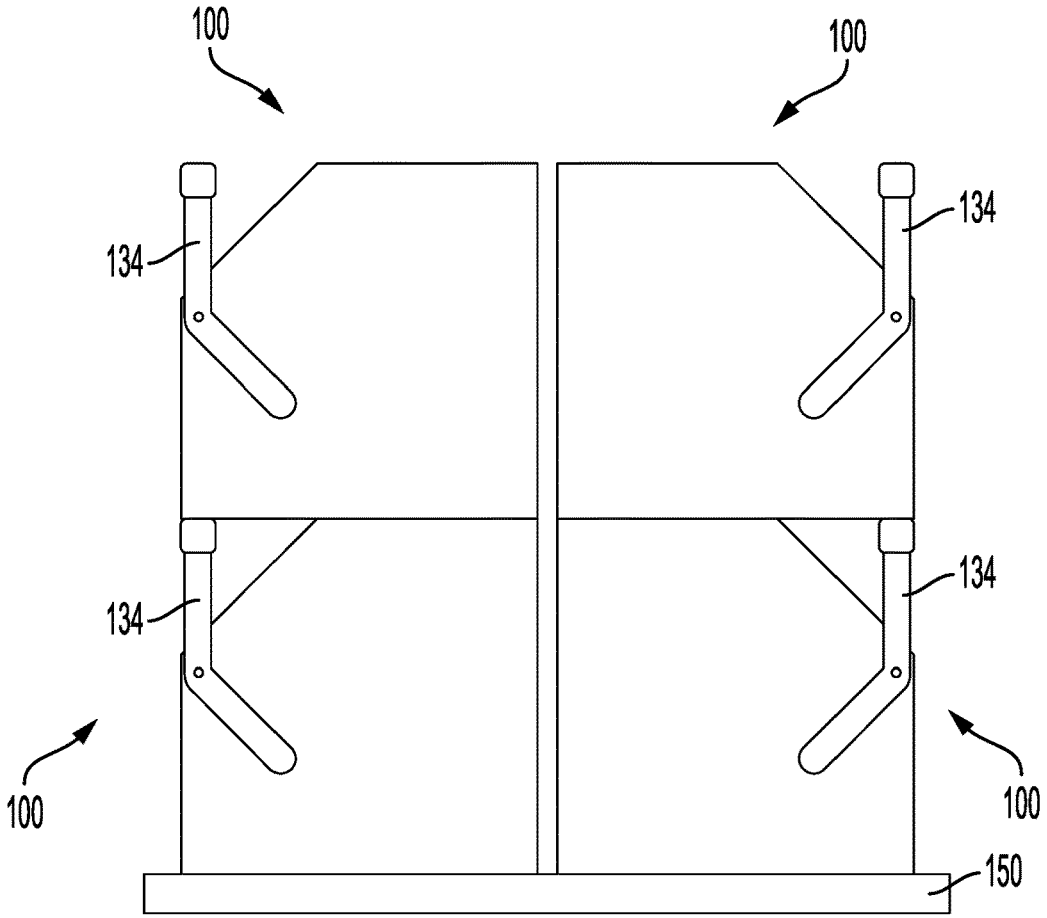
FIG. 8 depicts a front view of four hybrid cargo container systems stored on a ground transportation vehicle, according to an example implementation.

FIG. 8 depicts a front view of four of the hybrid cargo container system 100 stored in two stacks of two on a truck bed 150 of ground transportation vehicle 116 (not shown), according to an example implementation. As shown with each of the bottom two systems, the pair of supports 134 are in the deployed position, thus allowing the hybrid cargo container system 100 to support another such system stacked thereon.

Figure 9:
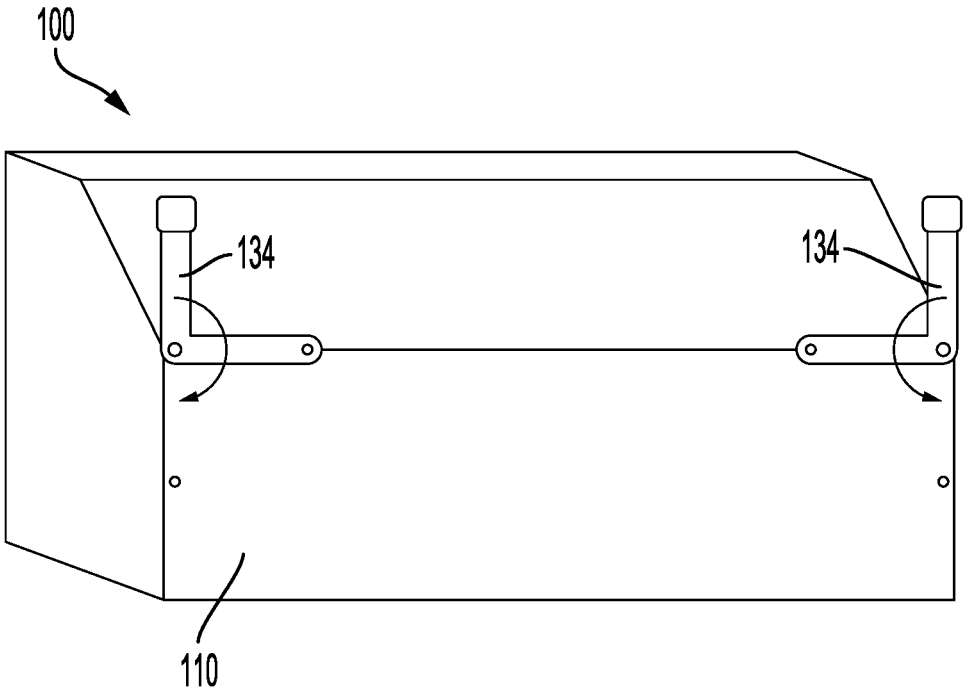
FIG. 9 depicts another hybrid cargo container system with the corner support assembly in the deployed position, according to an example implementation.
Figure 10:
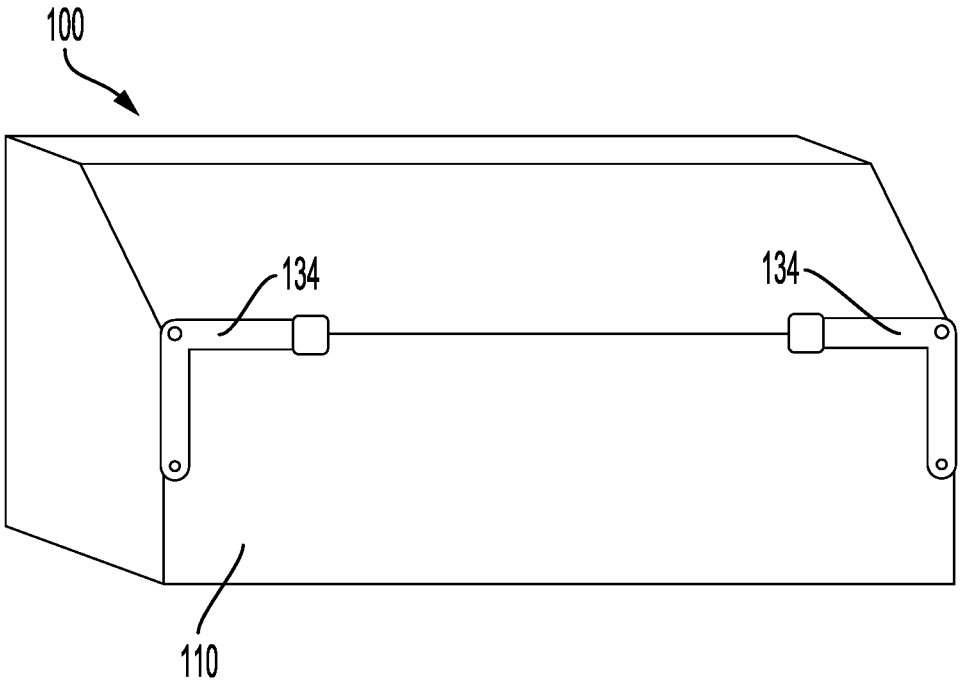
FIG. 10 depicts the hybrid cargo container system of FIG. 9 with the corner support assembly in the stowed position, according to an example implementation.

FIGS. 9 and 10 depict an example of the corner support assembly 104 in which the pair of supports 134 are pivotably coupled to opposite ends of one of the pair of longitudinal sidewalls 124—namely, the second sidewall 110, according to an example implementation. In particular, FIG. 9 depicts the pair of supports 134 in the deployed position. FIG. 10 then depicts the pair of supports 134 in the stowed position. For reference, FIG. 9 includes arrows depicting the direction in which the pair of supports 134 can rotate from the deployed position to the stowed position.

Although not explicitly shown, in some examples the corner support assembly 104 can include a plurality of posts having more than two posts, such as a pair of posts coupled to the pair of lateral sidewalls 122 and a third post coupled to the second sidewall 110.

Figure 11:
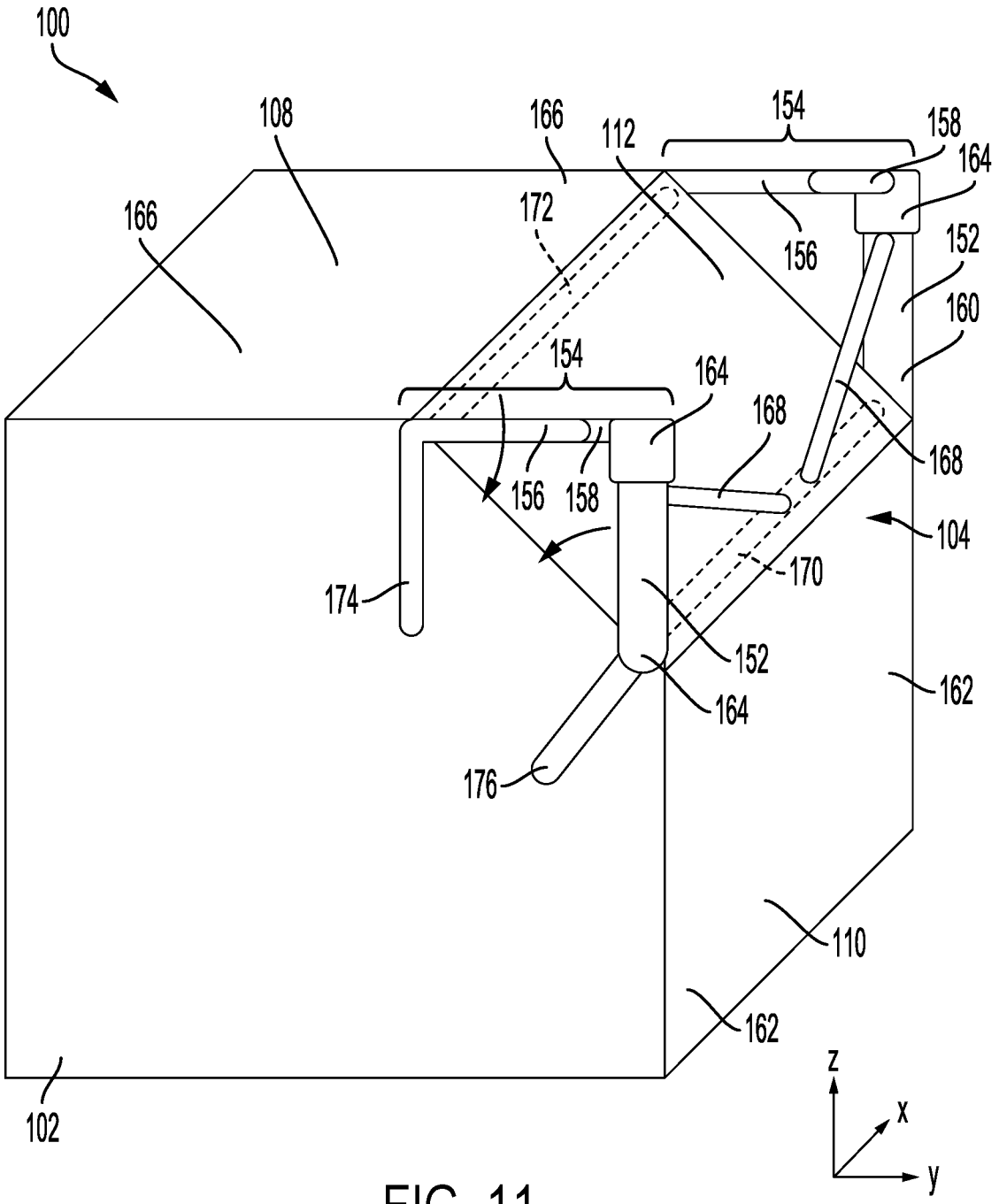
FIG. 11 depicts another hybrid cargo container system, according to an example implementation.

FIG. 11 depicts another example embodiment of the hybrid cargo container system 100. In particular, the corner support assembly 104 includes a pair of posts 152 in the deployed position, which can be the same as or different from the pair of supports 134 depicted in the aforementioned Figures. The corner support assembly 104 also includes a pair of hinged members 154, each of which comprises a respective inner side brace link 156 pivotably coupled to a respective outer side brace link 158. The pair of posts 152 have proximal ends 160 coupled at opposite longitudinal ends 162 of the second sidewall 110 and distal ends 164 coupled to opposite longitudinal ends 166 of the first sidewall 108 via the pair of hinged members 154.

The corner support assembly 104 also includes a pair of additional members 168 that can slide back and forth parallel to the x-axis (e.g., along a track (not shown) disposed on an exterior surface of the chamfer sidewall 112) and are configured to provide additional support and help reduce or prevent bending of the pair of posts 152 in the y-direction. In alternative examples, the pair of additional members 168 are not included.

In addition, the corner support assembly 104 also includes (i) a first torsion member 170 extending longitudinally between the proximal ends 160 and (ii) a second torsion member 172 extending longitudinally between the pair of hinged members 154, each torsion member being configured to cause substantially simultaneous actuation of the pair of posts 152 between the deployed position and the stowed position. In alternative examples, the first torsion member 170 and/or the second torsion member 172 is/are not included.

Still further, the corner support assembly 104 includes a side brace actuation lever 174 and a corner post actuation lever 176 for actuating the pair of posts 152 between the deployed position and the stowed position. FIG. 11 includes representative arrows showing a direction of movement of the pair of posts 152 and the pair of hinged members 154 when the corner support assembly 104 moves from the deployed position to the stowed position.

Figure 12:
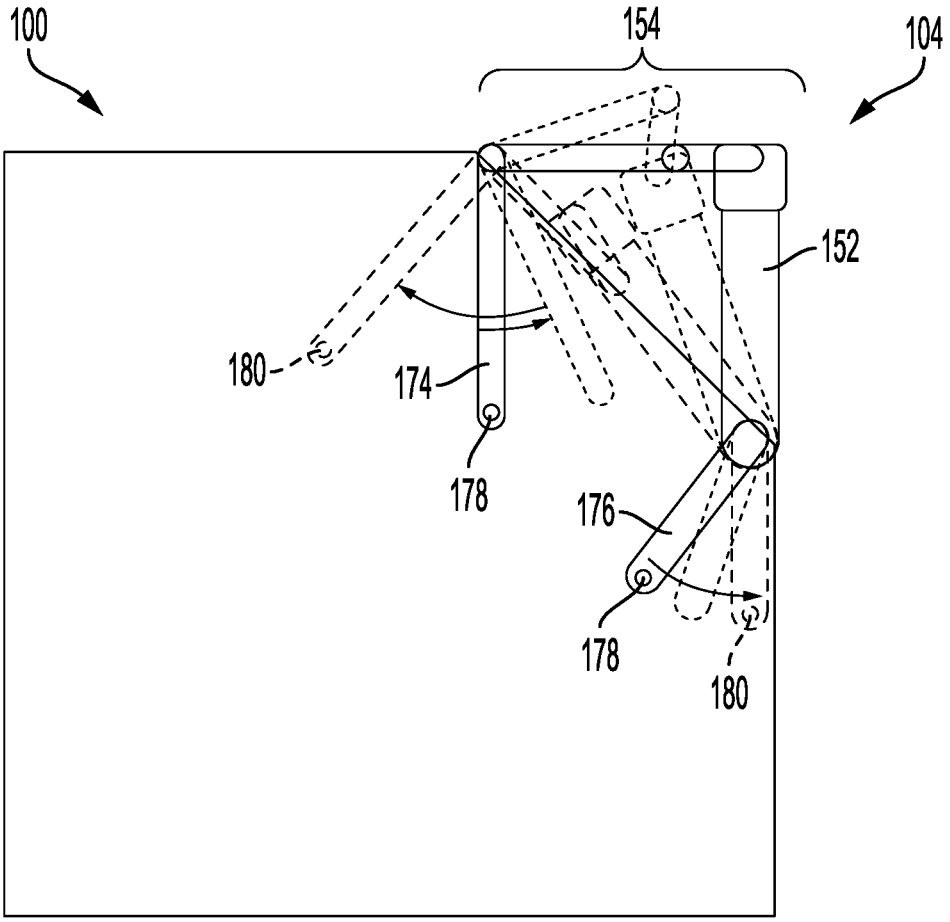
FIG. 12 depicts a front view of the hybrid cargo container system of FIG. 11, according to an example implementation.

To further illustrate movement of the pair of posts 152 between the deployed and stowed positions, FIG. 12 depicts a front view of the hybrid cargo container system 100 of FIG. 11, according to an example implementation. The dashed line represents the corner support assembly 104 in the deployed position, the dotted line represents the corner support assembly 104 in an intermediate position between the deployed and stowed positions, and the dashed line represents the corner support assembly 104 in the stowed position.

More particularly, to move the pair of posts 152 from the deployed position to the stowed position, the side brace actuation lever 174 and the corner post actuation lever 176 are detached/decoupled from a first pair of securing mechanisms 178 (e.g., latches, detents, plungers, etc.) and rotated to the intermediate position in the direction shown by the arrows. This causes the pair of hinged members 154 to bend as shown, after which the side brace actuation lever 174 and the corner post actuation lever 176 can be moved from the intermediate position to the stowed position in the direction shown by the arrows. The side brace actuation lever 174 and the corner post actuation lever 176 are then attached/coupled to a second pair of securing mechanisms 180 (e.g., latches, detents, plungers, etc.), thus securing the pair of posts 152 in the stowed position.

Figure 13:
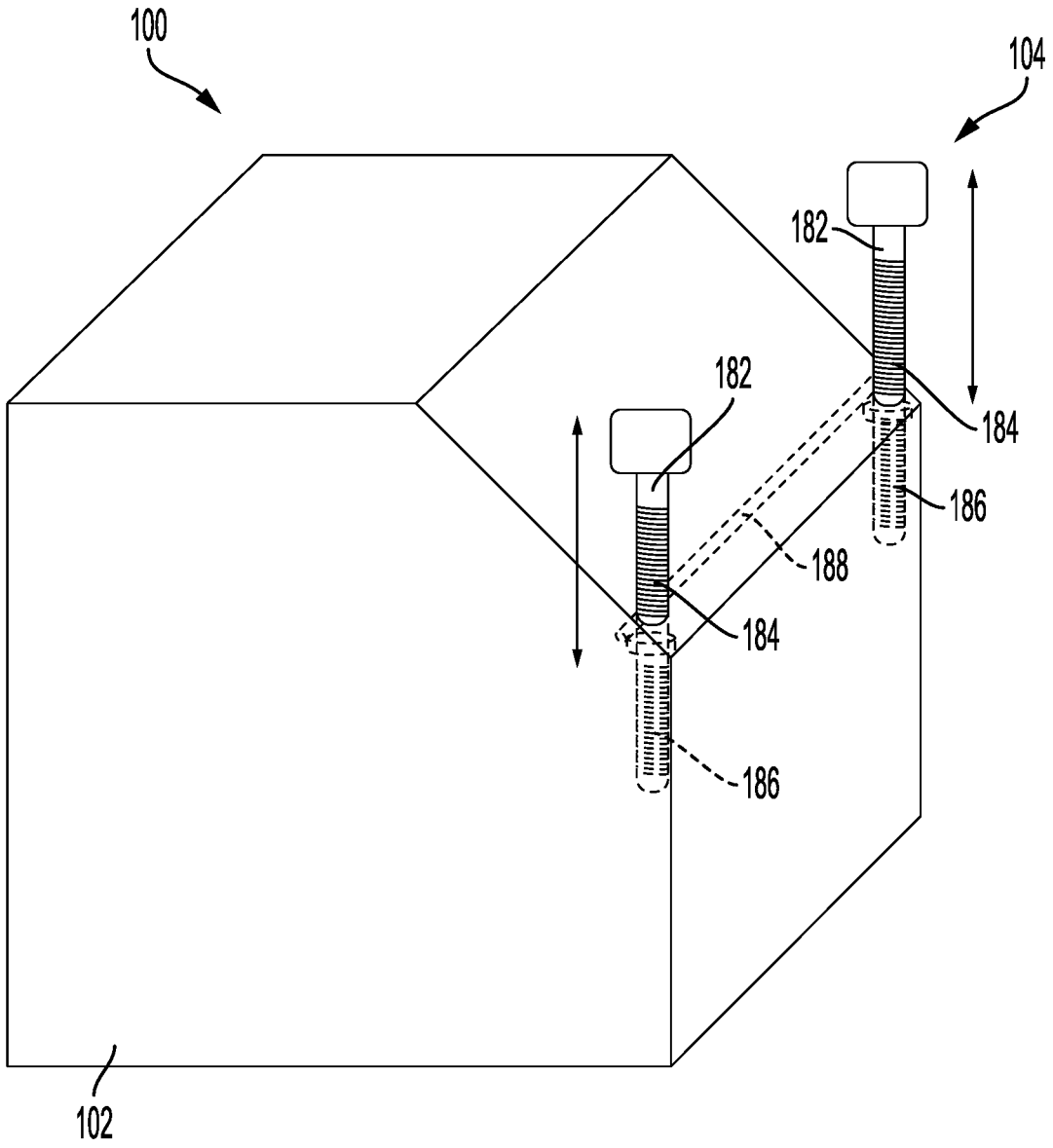
FIG. 13 depicts another hybrid cargo container system, according to an example implementation.

FIG. 13 depicts yet another example embodiment of the hybrid cargo container system 100, according to an example implementation. In particular, the corner support assembly 104 includes a pair of supports 182 having threaded proximal ends 184, and also includes a pair of threaded screw jack sleeves 186 configured to receive the threaded proximal ends 184 of the pair of supports 182. FIG. 13 includes arrows depicting the direction of movement of the pair of supports 182 between the deployed position and the stowed position.

The pair of threaded screw jack sleeves 186 can be disposed in and attached to existing cavities present in the chamfered container body 102, or can be integral with the chamfered container body 102, while conforming with typical standards for intermodal containers, for instance. Within examples in which a high-friction system is used (e.g., not a ball screw) for the pair of threaded screw jack sleeves 186, the screw jack mechanism for actuating the pair of supports 182 cannot be driven under load and/or high vibration, thus helping to increase safety and reliability in both the stowed and deployed positions.

In some cases, the corner support assembly 104 also includes a drive shaft 188 extending longitudinally between the pair of threaded screw jack sleeves 186 and configured to cause substantially simultaneous actuation of the pair of supports 182 between the deployed position and the stowed position. The drive shaft 188 can be driven from either end by hand, with a power hand tool (e.g. cordless electric screwdriver), or by internal power and actuators, for example.

Figure 16:
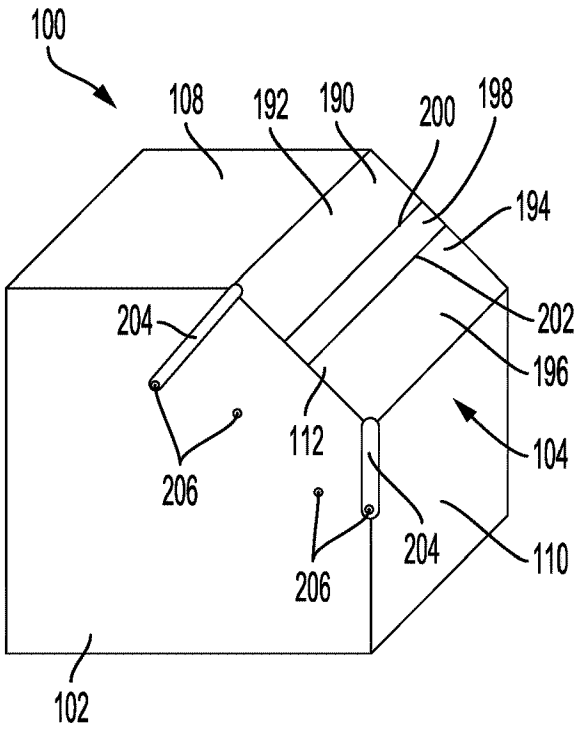
FIG. 16 depicts the hybrid cargo container system of FIG. 14 with the corner support assembly in the stowed position, according to an example implementation.
Figure 15:
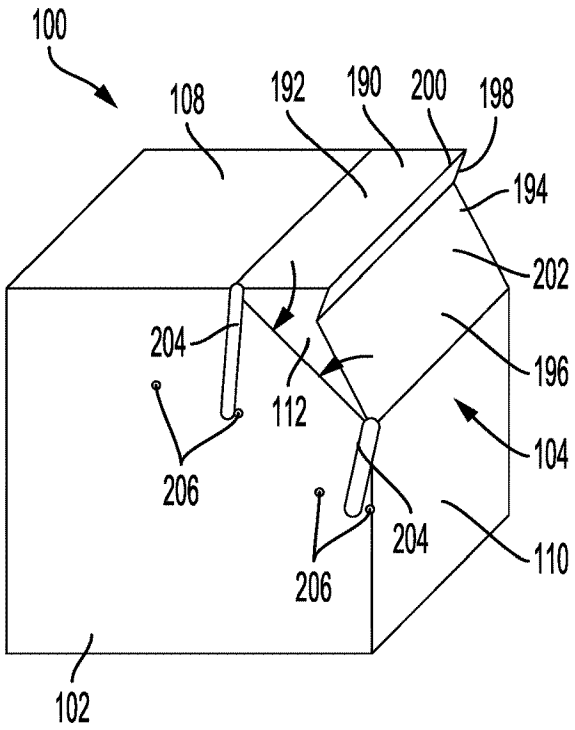
FIG. 15 depicts the hybrid cargo container system of FIG. 14 with the corner support assembly in an intermediate position between the deployed position and the stowed position, according to an example implementation.
Figure 14:
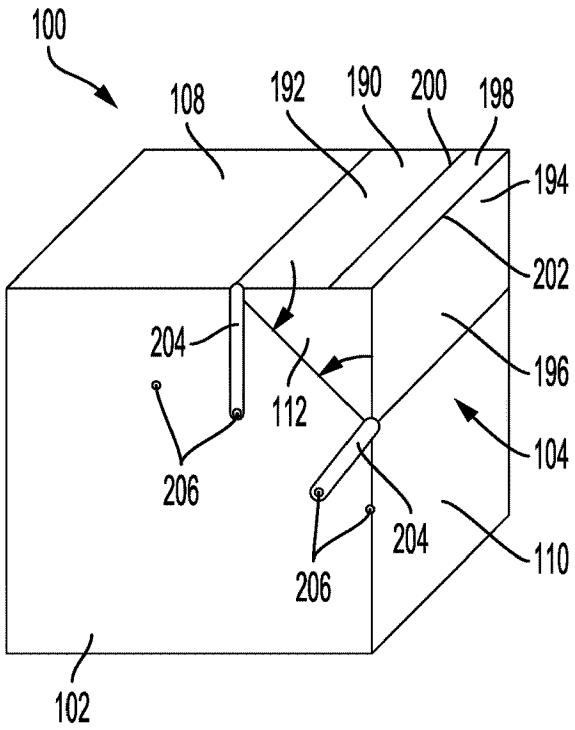
FIG. 14 depicts another hybrid cargo container system with the corner support assembly in the deployed position, according to an example implementation.

FIGS. 14, 15, and 16 depict yet another example embodiment of the hybrid cargo container system 100, according to an example implementation.

In particular, FIG. 14 depicts the hybrid cargo container system 100 in the deployed position. As shown, the corner support assembly 104 includes a plurality of hinged panels. The plurality of hinged panels include a first panel 190 having a proximal end 192 connected to the first sidewall 108, a second panel 194 having a proximal end 196 connected to the second sidewall 110, and a third panel 198 hinged between a distal end 200 of the first panel 190 and a distal end 202 of the second panel 194. The corner support assembly 104 also includes a pair of levers 204 and a plurality of securing mechanisms 206, which can facilitate movement of the corner support assembly 104 between the deployed and stowed positions in much the same way as described above with respect to the embodiment of FIGS. 11 and 12.

Accordingly, FIG. 15 next depicts the hybrid cargo container system 100 with the corner support assembly 104 in an intermediate position between the deployed and stowed positions.

FIG. 16 then depicts the hybrid cargo container system 100 with the corner support assembly 104 in the stowed position, such that the plurality of panels are substantially parallel to the chamfer sidewall 112.

Figure 17:
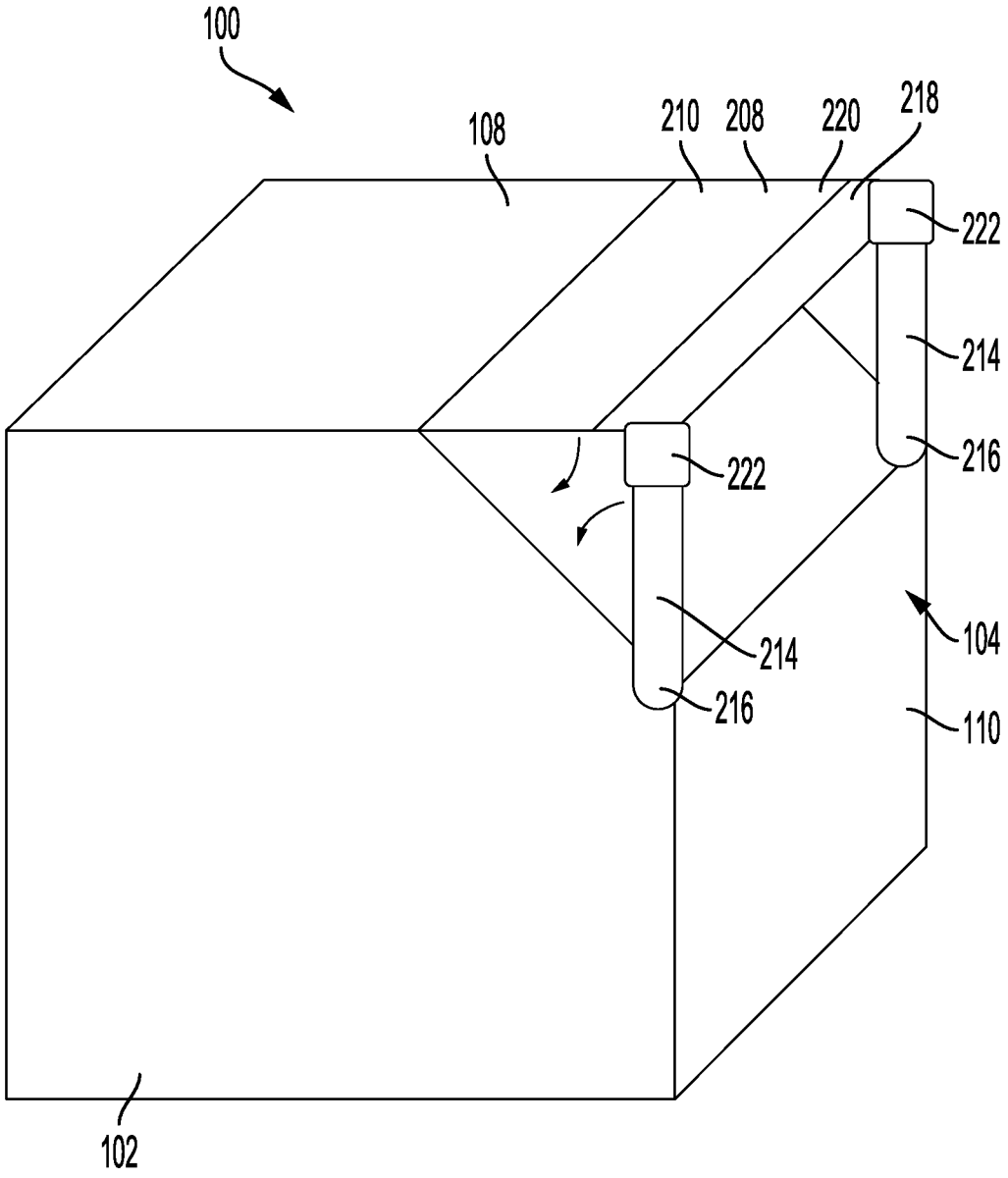
FIG. 17 depicts another hybrid cargo container system, according to an example implementation.

FIG. 17 depicts yet another example embodiment of the hybrid cargo container system 100, according to an example implementation. In particular, the corner support assembly 104 includes a first panel 208 having a proximal end 210 connected to the first sidewall 108, a pair of supports 214 having proximal ends 216 rotatably coupled to the chamfered container body 102, and a second panel 218 hinged between a distal end 220 of the first panel 208 and corner fittings 222 attached to the pair of supports 214.

Figure 18:
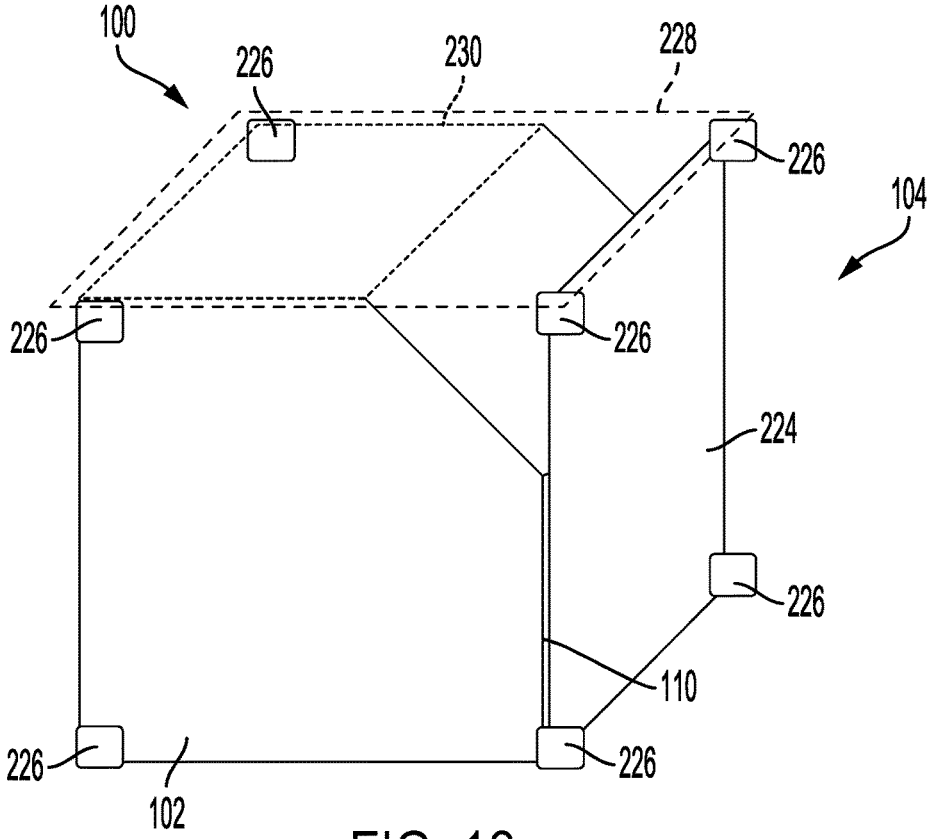
FIG. 18 depicts another hybrid cargo container system, according to an example implementation.
Figure 19:
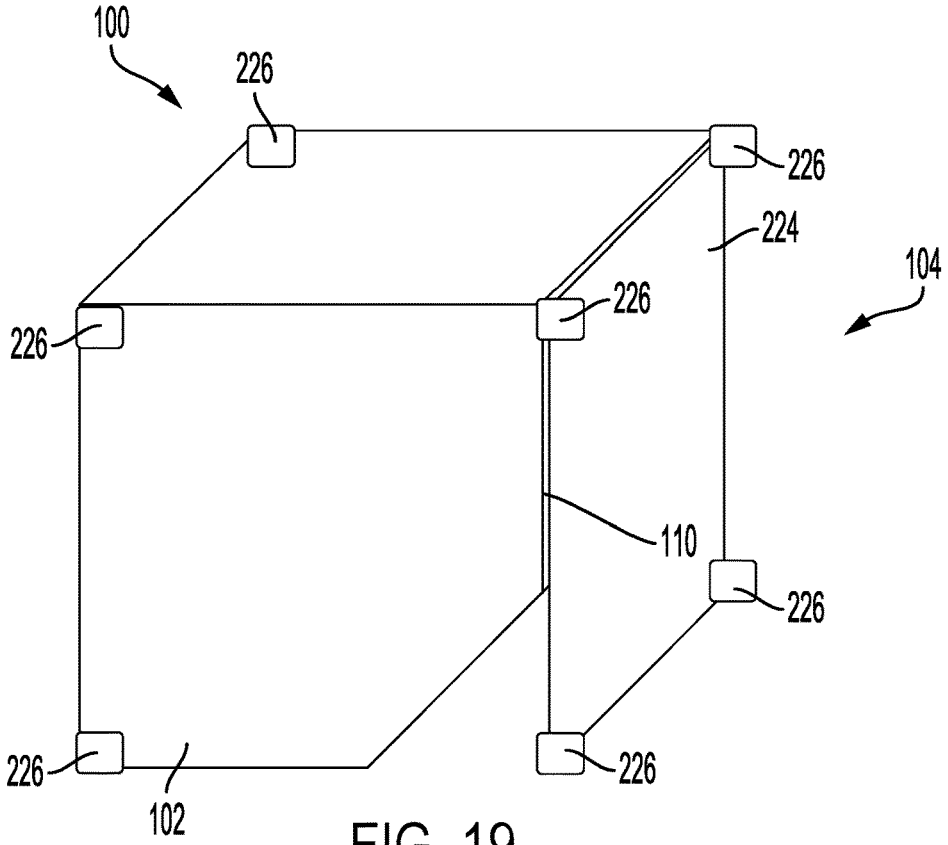
FIG. 19 depicts another hybrid cargo container system, according to an example implementation.

FIGS. 18 and 19 depict an example embodiment in which the corner support assembly is removably coupled to the chamfered container body 102.

In particular, FIG. 18 depicts yet another example embodiment of the hybrid cargo container system 100, according to an example implementation. As shown, the corner support assembly 104 includes a frame 224 that is removably fastened the second sidewall 110. In practice, the frame 224 can be made of metal (e.g., welded steel) or other material(s), and can be fastened to the second sidewall 110 by way of one or more fasteners (not shown) such as truss or corrugated fasteners (e.g., bolts). The frame 224 is relatively flat, which can make it easier to store the frame 224 at airports after removing the frame 224.

In addition, corner fittings 226, such as those configured as described above with respect to aforementioned Figures, can be coupled to each corner of the hybrid cargo container system 100.

As further shown, the hybrid cargo container system 100 defines a first planar support region 228 based on the frame 224 being coupled to the chamfered container body 102, and would define a second planar support region 230 based on the frame 224 being removed from the chamfered container body 102.

FIG. 19 depicts the hybrid cargo container system 100 of FIG. 18, but oriented upside-down, according to an example implementation. In some cases, the hybrid cargo container system 100 can be oriented in this way and stacked on a floor surface (e.g., of a truck bed or aircraft) or on another container.

Embodiments such as those in FIGS. 18-19 where the corner support assembly 104 is removably coupled to the chamfered container body 102 can be advantageous because the corner support assembly 104 is removed in order to load the container on an aircraft and does not need to fly with the aircraft, and thus the corner support assembly 104 can be designed to be heavier and more robust compared to the chamfered container body 102.

FIGS. 20, 21, 22, and 23 depict arrangements in which the hybrid cargo container system 100 (not explicitly shown in FIGS. 20-23) includes a lever arm 232 coupled to one sidewall of the chamfered container body 102 (not designated in FIGS. 20-23)—namely, the second sidewall 110—and rotatable about an axis 234 that is transverse to the second sidewall 110. In particular, the lever arm 232 is shown to be used for actuating a representative example of a support 236 of the corner support assembly 104. For illustrative purposes, only a portion of the support 236 is shown.

Figure 20:
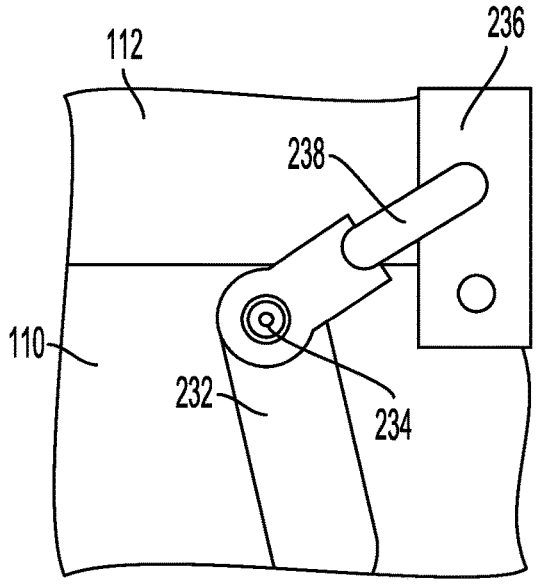
FIG. 20 depicts a lever arm arrangement with a linkage, according to an example implementation.
Figure 21:
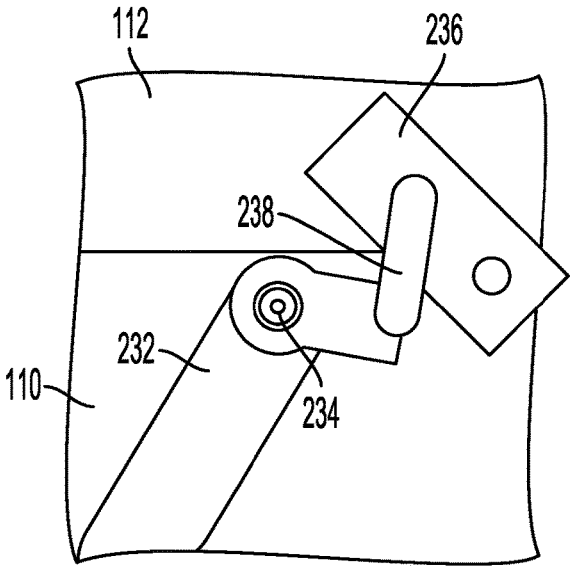
FIG. 21 depicts the lever arm arrangement of FIG. 20, according to an example implementation.

FIGS. 20 and 21 depict a lever arm arrangement in which the hybrid cargo container system 100 also includes a link 238 that couples the lever arm 232 to the support 236. As such, rotation of the lever arm 232 causes rotation of the link 238, thereby causing movement of the support 236 between the deployed position and the stowed position. FIG. 20 depicts the support 236 in the deployed position, and FIG. 21 depicts the support 236 in an intermediate position between the deployed position and the stowed position.

Figure 22:
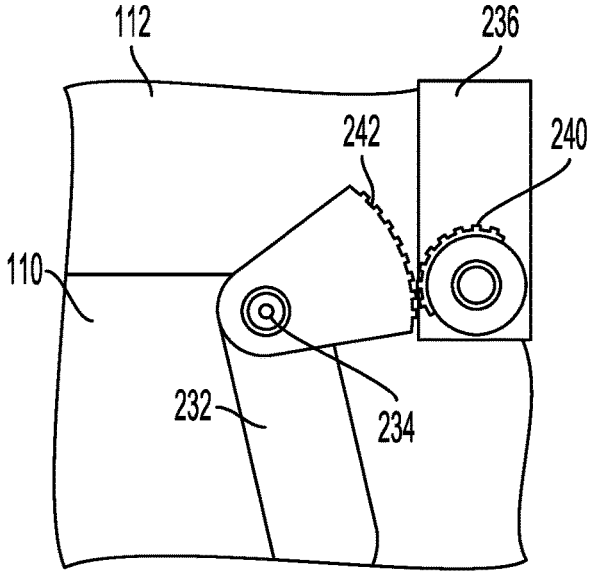
FIG. 22 depicts a lever arm arrangement with a gear, according to an example implementation.
Figure 23:
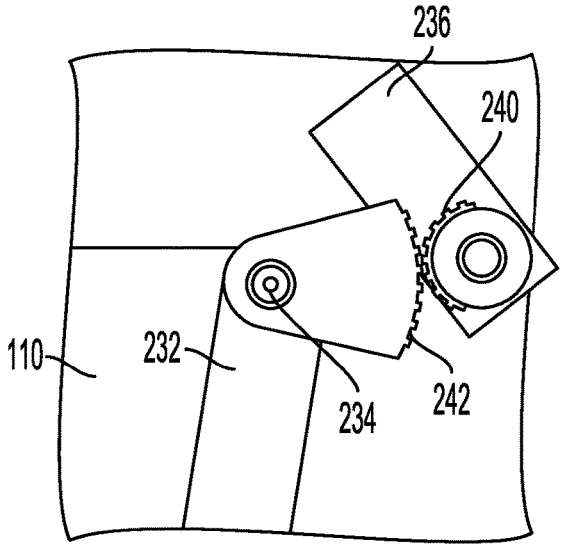
FIG. 23 depicts the lever arm arrangement of FIG. 22, according to an example implementation.

FIGS. 22 and 23 next depict a lever arm arrangement in which the support 236 includes first gear teeth 240 and a proximal end of the lever arm 232 includes second gear teeth 242 configured to engage with the first gear teeth 240 such that rotation of the lever arm 232 causes movement of the support 236 between the deployed position and the stowed position. FIG. 22 depicts the support 236 in the deployed position, and FIG. 23 depicts the support 236 in an intermediate position between the deployed position and the stowed position.

Figure 24:
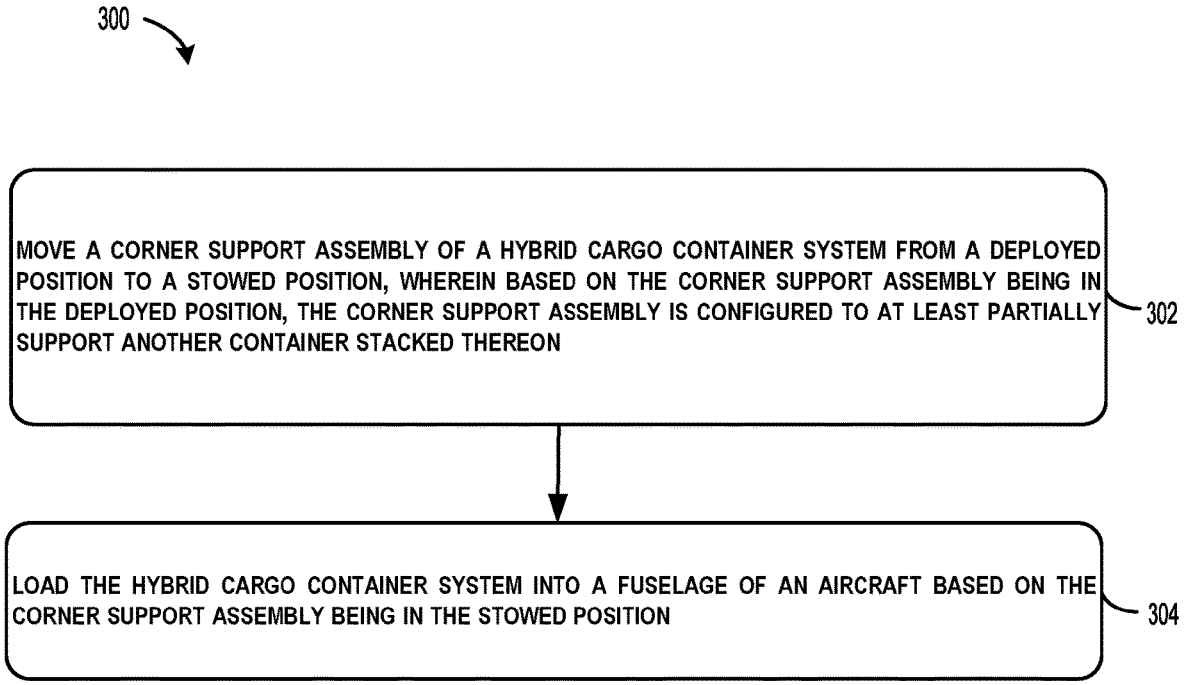
FIG. 24 shows a flowchart of a method, according to an example implementation.

FIG. 24 shows a flowchart of an example of a method 300. Method 300 could be used with the hybrid cargo container system 100 and components thereof shown in FIGS. 1-23. Method 300 may include one or more operations, functions, or actions as illustrated by one or more of blocks 302-304.

At block 302, the method 300 includes moving a corner support assembly of a hybrid cargo container system from a deployed position to a stowed position, where based on the corner support assembly being in the deployed position, the corner support assembly is configured to at least partially support another container stacked thereon.

At block 304, the method 300 includes loading the hybrid cargo container system into a fuselage of an aircraft based on the corner support assembly being in the stowed position.

In some embodiments, moving the corner support assembly from the deployed position to the stowed position involves moving the corner support assembly from the deployed position to the stowed position to cause the hybrid cargo container system to define less of a volume in the stowed position than when in the deployed position.

In some embodiments, moving the corner support assembly of the hybrid cargo container system from the deployed position to the stowed position involves moving a corner support assembly that is coupled to at least one sidewall of a plurality of sidewalls of a chamfered container body of the hybrid cargo container system, the plurality of sidewalls define a storage chamber for storing and transporting items therein, and the plurality of sidewalls comprises a first sidewall, a second sidewall, and a chamfer sidewall that is attached to, and extends transverse to, the first sidewall and the second sidewall. Further, in such embodiments, moving the corner support assembly from the deployed position to the stowed position involves moving the corner support assembly from the deployed position to the stowed position to cause the corner support assembly to occupy less of a corner space exterior to and adjacent to the chamfer sidewall than when in the deployed position. Additionally, in such embodiments, loading the hybrid cargo container system into the fuselage of the aircraft based on the corner support assembly being in the stowed position comprises loading the hybrid cargo container system into the fuselage of the aircraft such that a curved sidewall of the fuselage occupies at least a portion of the corner space.

In some embodiments, the method 300 also includes unloading the hybrid cargo container system from the fuselage of the aircraft based on the corner support assembly being in the stowed position, and moving the corner support assembly from the stowed position to the deployed position. Further, in such embodiments, the method 300 also includes loading the hybrid cargo container system directly from the aircraft and onto a ground transportation vehicle, and stacking another container on the hybrid cargo container system based on the corner support assembly being in the deployed position.

Different examples of the system(s), device(s), and method(s) disclosed herein include a variety of components, features, and functionalities. It should be understood that the various examples of the system(s), device(s), and method(s) disclosed herein may include any of the components, features, and functionalities of any of the other examples of the system(s), device(s), and method(s) disclosed herein in any combination or any sub-combination, and all of such possibilities are intended to be within the scope of the disclosure.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. A hybrid cargo container system for use with ground transportation vehicles and air transportation vehicles, the hybrid cargo container system comprising:

a chamfered container body comprising a plurality of sidewalls defining a storage chamber, the plurality of sidewalls comprising a first sidewall, a second sidewall, and a chamfer sidewall attached to the first sidewall and the second sidewall; and a corner support assembly operably coupled to the chamfered container body, wherein the corner support assembly is operable between a stowed position and a deployed position, wherein based on the corner support assembly being in the deployed position, the corner support assembly is configured to at least partially support another container stacked thereon for ground transportation, wherein based on the corner support assembly being in the stowed position, the hybrid cargo container system is configured to be stored in a fuselage of an aircraft for air transportation, and wherein the hybrid cargo container system defines a first volume when the corner support assembly is in the deployed position and a second volume that is less than the first volume when the corner support assembly is in the stowed position.

2. The hybrid cargo container system of claim 1, wherein:

the chamfered container body is prism-shaped with a pentagonal cross section.

3. The hybrid cargo container system of claim 1, wherein:

the chamfer sidewall extends transverse to the first sidewall and the second sidewall.

4. The hybrid cargo container system of claim 1, wherein:

the first sidewall defines a first plane, the second sidewall defines a second plane that is substantially perpendicular to the first plane, and the chamfer sidewall defines a chamfer plane that is non-orthogonal relative to the first plane and the second plane.

5. The hybrid cargo container system of claim 1, wherein:

based on the corner support assembly being in the deployed position, the hybrid cargo container system defines a first planar support region configured to at least partially support another container stacked thereon, and based on the corner support assembly being in the stowed position, the hybrid cargo container system defines a second planar support region, smaller than the first planar support region.

6. The hybrid cargo container system of claim 1, wherein:

based on the corner support assembly being in the deployed position, the corner support assembly extends into a corner space exterior to and adjacent to the chamfer sidewall, and based on the corner support assembly being in the stowed position, the corner support assembly is retracted toward the chamfer sidewall and occupies less of the corner space than when in the deployed position.

7. The hybrid cargo container system of claim 1, wherein:

based on the corner support assembly being in the stowed position, the hybrid cargo container system is configured to be stored in the fuselage of the aircraft for air transportation such that a curved sidewall of the fuselage occupies at least a portion of a corner space exterior to and adjacent to the chamfer sidewall.

8. The hybrid cargo container system of claim 1, wherein the corner support assembly comprises a plurality of posts rotatably coupled to the chamfered container body and rotatable between the deployed position and the stowed position.

9. The hybrid cargo container system of claim 1, wherein:

the corner support assembly comprises a pair of posts and a pair of hinged members, and the pair of posts have proximal ends coupled at opposite longitudinal ends of the second sidewall and distal ends coupled to opposite longitudinal ends of the first sidewall via the pair of hinged members.

10. The hybrid cargo container system of claim 9, wherein:

the corner support assembly further comprises a torsion member extending longitudinally between the proximal ends and configured to cause substantially simultaneous actuation of the pair of posts between the deployed position and the stowed position.

11. The hybrid cargo container system of claim 1, wherein:

the corner support assembly comprises a plurality of hinged panels, and the plurality of hinged panels comprise a first panel having a proximal end connected to the first sidewall, a second panel having a proximal end connected to the second sidewall, and a third panel hinged between a distal end of the first panel and a distal end of the second panel.

12. The hybrid cargo container system of claim 1, wherein:

the corner support assembly comprises a pair of supports having threaded proximal ends, and the corner support assembly further comprises a pair of threaded screw jack sleeves configured to receive the threaded proximal ends of the pair of supports.

13. The hybrid cargo container system of claim 12, wherein:

the corner support assembly further comprises a drive shaft extending longitudinally between the pair of threaded screw jack sleeves and configured to cause substantially simultaneous actuation of the pair of supports between the deployed position and the stowed position.

14. The hybrid cargo container system of claim 1, further comprising:

a lever arm coupled to one sidewall of the plurality of sidewalls and rotatable about an axis transverse to the one sidewall; and a link that couples the lever arm to the corner support assembly, wherein rotation of the lever arm causes rotation of the link, thereby causing movement of the corner support assembly between the deployed position and the stowed position.

15. The hybrid cargo container system of claim 1, further comprising:

a lever arm coupled to one sidewall of the plurality of sidewalls and rotatable about an axis transverse to the one sidewall, wherein:

the corner support assembly comprises first gear teeth, and a proximal end of the lever arm comprises second gear teeth configured to engage with the first gear teeth such that rotation of the lever arm causes movement of the corner support assembly between the deployed position and the stowed position.

16. A hybrid cargo container system for use with ground transportation vehicles and air transportation vehicles, the hybrid cargo container system comprising:

a chamfered container body comprising a plurality of sidewalls defining a storage chamber, the plurality of sidewalls comprising a first sidewall that defines a first plane, a second sidewall that defines a second plane transverse to the first plane, and a chamfer sidewall that defines a chamfer plane that is non-orthogonal relative to the first plane and the second plane; and a corner support assembly removably coupled to the chamfered container body, wherein based on the corner support assembly being coupled to the chamfered container body, the hybrid cargo container system defines a first planar support region and is configured to at least partially support another container stacked thereon for ground transportation, and wherein based on the corner support assembly being removed from the chamfered container body, the hybrid cargo container system defines a second planar support region, smaller than the first planar support region, and is configured to be stored in a fuselage of an aircraft for air transportation.

17. The hybrid cargo container system of claim 16, wherein:

the chamfered container body is prism-shaped with a pentagonal cross section.

18. The hybrid cargo container system of claim 16, wherein:

based on the corner support assembly being coupled to the chamfered container body, the corner support assembly occupies at least a portion of a corner space that is exterior to and adjacent to the chamfer sidewall.

19. The hybrid cargo container system of claim 16, wherein:

the corner support assembly comprises a frame that is removably fastened the second sidewall.

20. A hybrid cargo container system comprising:

a chamfered container body comprising a plurality of sidewalls defining a storage chamber, the plurality of sidewalls comprising a pair of lateral sidewalls, a pair of longitudinal sidewalls, an upper sidewall, a lower sidewall, and a chamfer sidewall that is attached to, and extends transverse between, the upper sidewall and one longitudinal sidewall of the pair of longitudinal sidewalls; and a pair of supports pivotably coupled to opposite ends of the one longitudinal sidewall or to the pair of lateral sidewalls, wherein the pair of supports are rotatable between a stowed position and a deployed position, wherein based on the pair of supports being in the deployed position, the hybrid cargo container system defines a first volume and is configured to at least partially support another container stacked thereon, and wherein based on the pair of supports being in the stowed position, the hybrid cargo container system defines a second volume that is less than the first volume.

21. The hybrid cargo container system of claim 20, wherein:

based on the pair of supports being in the deployed position, the upper sidewall and the pair of supports define a first planar support region configured to at least partially support another container stacked thereon, and based on the pair of supports being in the stowed position, the upper sidewall defines a second planar support region smaller than the first planar support region.

22. The hybrid cargo container system of claim 20, wherein:

the pair of supports are pivotably coupled to the opposite ends of the one longitudinal sidewall.

23. The hybrid cargo container system of claim 20, wherein:

the pair of supports are pivotably coupled to the pair of lateral sidewalls.

* * * * *